US007523940B1

(12) United States Patent
Jacobson

(10) Patent No.: US 7,523,940 B1
(45) Date of Patent: Apr. 28, 2009

(54) BASEBALL DICE GAME SYSTEM

(76) Inventor: Ken Jacobson, 630 Indianapolis Ave., Apartment A, Huntington Beach, CA (US) 92648

( * ) Notice: Subject to any disclaimer, the term of this patent is extended or adjusted under 35 U.S.C. 154(b) by 20 days.

(21) Appl. No.: 11/758,523

(22) Filed: Jun. 5, 2007

(51) Int. Cl.
*A63F 3/00* (2006.01)

(52) U.S. Cl. ..... 273/244.1; 273/259; 273/277

(58) Field of Classification Search ..... 273/244, 273/244.1, 245, 259, 277, 285, 287, 309
See application file for complete search history.

(56) References Cited

U.S. PATENT DOCUMENTS

| | | | | | |
|---|---|---|---|---|---|
| 726,062 | A * | 4/1903 | Honeck | 273/244.1 |
| 1,561,421 | A * | 11/1925 | Erickson | 273/244.1 |
| 1,585,920 | A * | 5/1926 | Isabelle et al. | 273/244.1 |
| 1,733,383 | A * | 10/1929 | Morris | 116/225 |
| 1,819,932 | A * | 8/1931 | Walden | 273/317.3 |
| 2,139,493 | A * | 12/1938 | Field | 116/222 |
| 4,244,571 | A | 1/1981 | Haglof | |
| 4,261,569 | A | 4/1981 | Frohlich | |
| 4,452,453 | A | 6/1984 | Daley et al. | |
| 4,687,199 | A | 8/1987 | Aguirregomezcorta | |
| 5,129,651 | A | 7/1992 | Tobias, Jr. | |
| D353,408 | S | 12/1994 | Springer | |
| 5,884,914 | A * | 3/1999 | Lilien | 273/244.1 |

* cited by examiner

*Primary Examiner*—Vishu K. Mendiratta

(57) ABSTRACT

A baseball dice game system for playing a game of baseball with dice includes a case including a bottom wall and a perimeter wall that extends upwardly from the bottom wall to define a playing space of the case. The case has a plurality of base apertures that extend into the bottom wall through a playing surface of the bottom wall and are positioned to represent bases of a baseball diamond. The case includes a plurality of pitch result apertures. The pitch result apertures are arranged in a grid comprising three strike columns and four ball rows. The pitch result apertures are positioned adjacent an area representative of home plate of a baseball diamond. A pair of play dice is rolled to determine a result of a pitch. A plurality of player pegs is inserted into the base apertures and the pitch result apertures when the play dice are rolled.

3 Claims, 5 Drawing Sheets

BASEBALL DICE GAME SYSTEM

BACKGROUND OF THE INVENTION

1. Field of the Invention

The present invention relates to baseball board games and more particularly pertains to a new baseball board game for playing a game of baseball with dice.

2. Description of the Prior Art

The uses of baseball board games is known in the prior art. While these devices fulfill their respective, particular objectives and requirements, the need remains for a system that has certain improved features that uses a plurality of strike columns and ball rows of pitch result apertures to indicate the outcome of pitches on the rolls of play dice. Additionally, the system should include stealing dice to indicate the results of one player declaring to steal a base.

SUMMARY OF THE INVENTION

The present invention meets the needs presented above by generally comprising a case including a bottom wall and a perimeter wall that extends upwardly from the bottom wall to define a playing space of the case. The case has a plurality of base apertures that extend into the bottom wall through a playing surface of the bottom wall. The base apertures are positioned to represent bases of a baseball diamond. The case includes a plurality of pitch result apertures. The pitch result apertures are arranged in a grid comprising three strike columns and four ball rows. The pitch result apertures are positioned adjacent an area representative of home plate of a baseball diamond. A pair of play dice is rolled to determine a result of a pitch. The play dice are stored in the playing space when the play dice are not being used. A plurality of player pegs is inserted into the base apertures and the pitch result apertures when the play dice are rolled. The player pegs are positioned in the playing space when the player pegs are not is use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
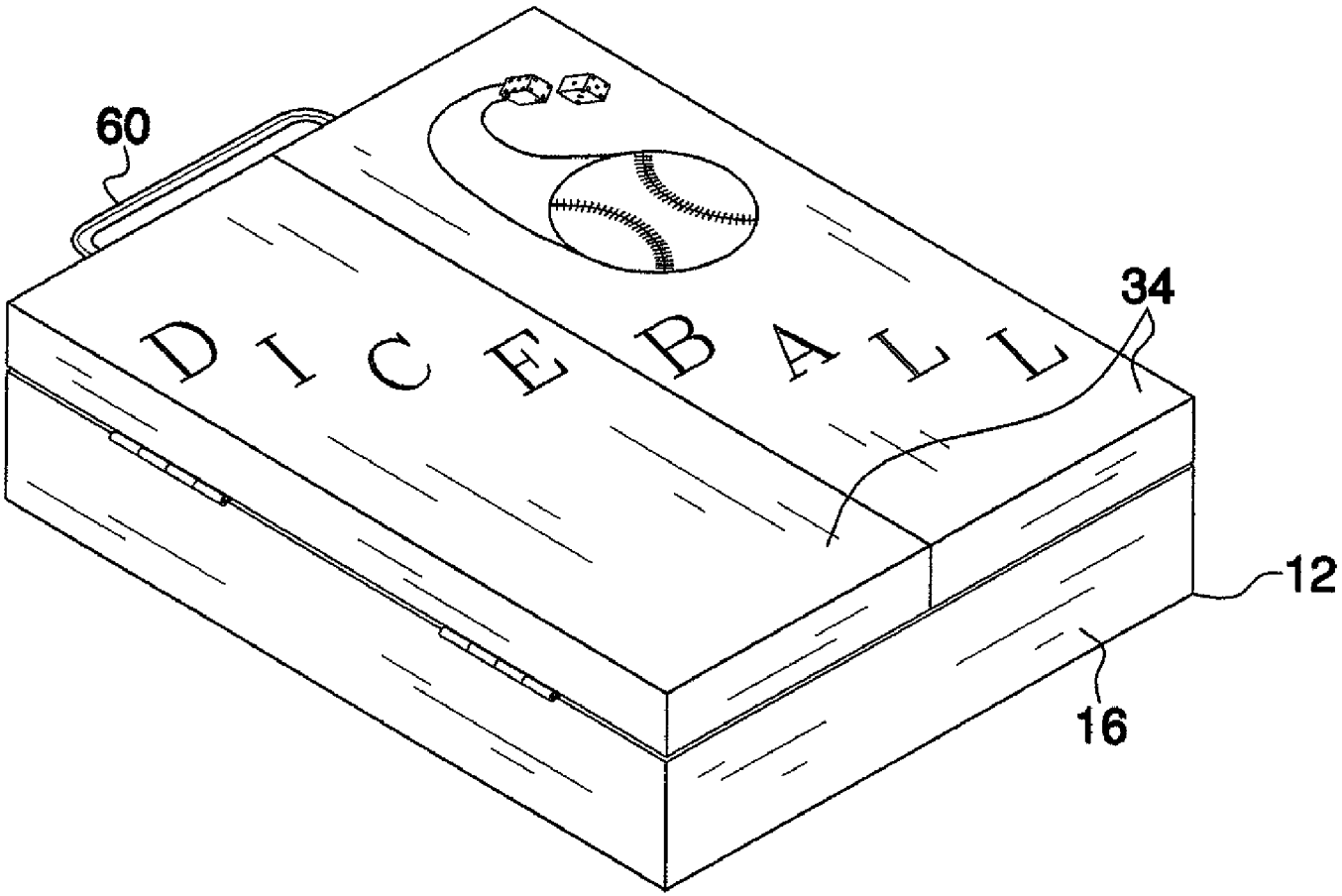
FIG. 1 is a perspective view of a baseball dice game system according to the present invention shown closed for storage.
Figure 2:
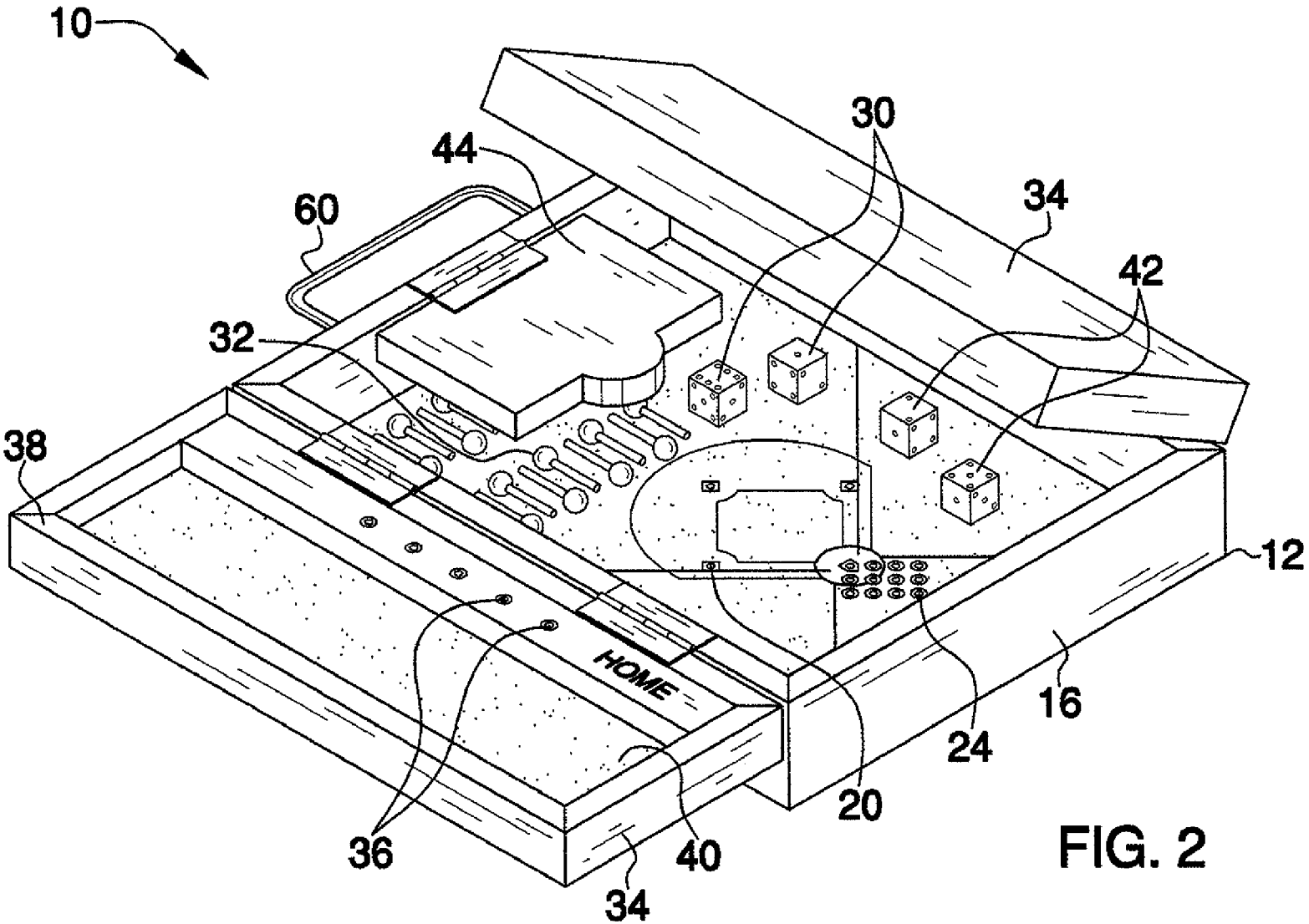
FIG. 2 is a perspective view of the present invention in the process of being opened for play.
Figure 3:
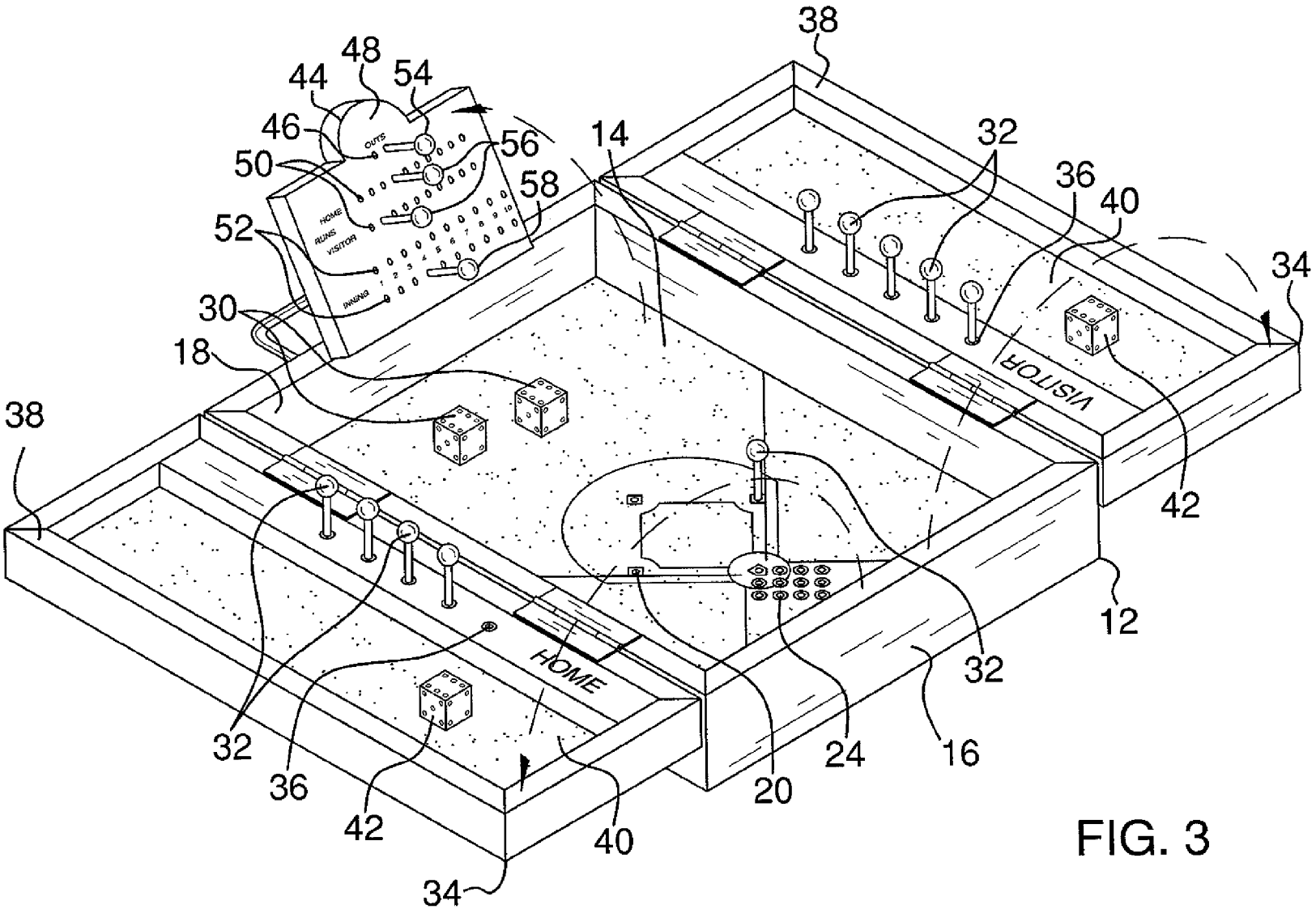
FIG. 3 is a perspective view of the present invention opened for play.
Figure 4:
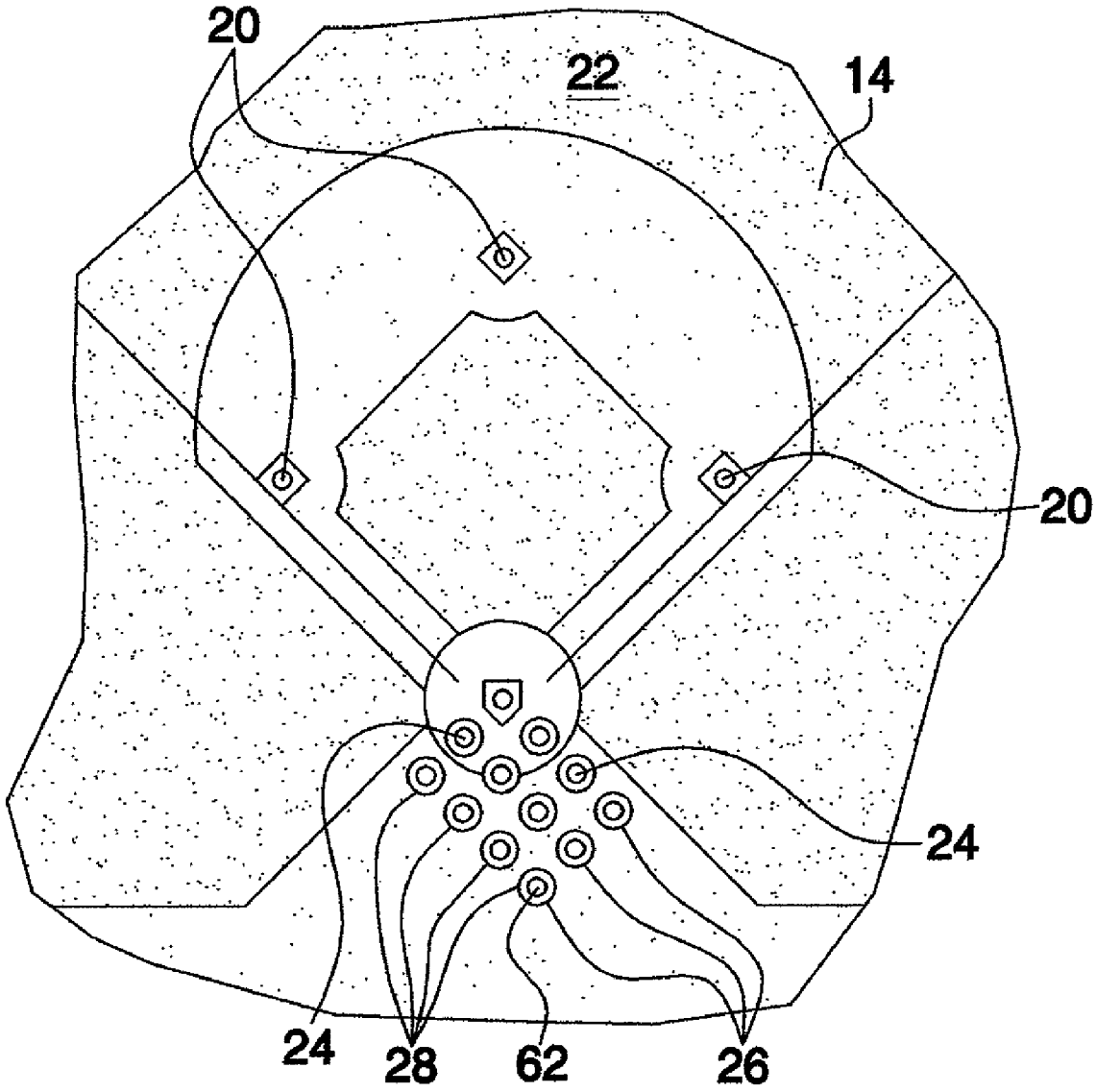
FIG. 4 is an enlarged top view of the base apertures and pitch result apertures of the present invention.
Figure 5:
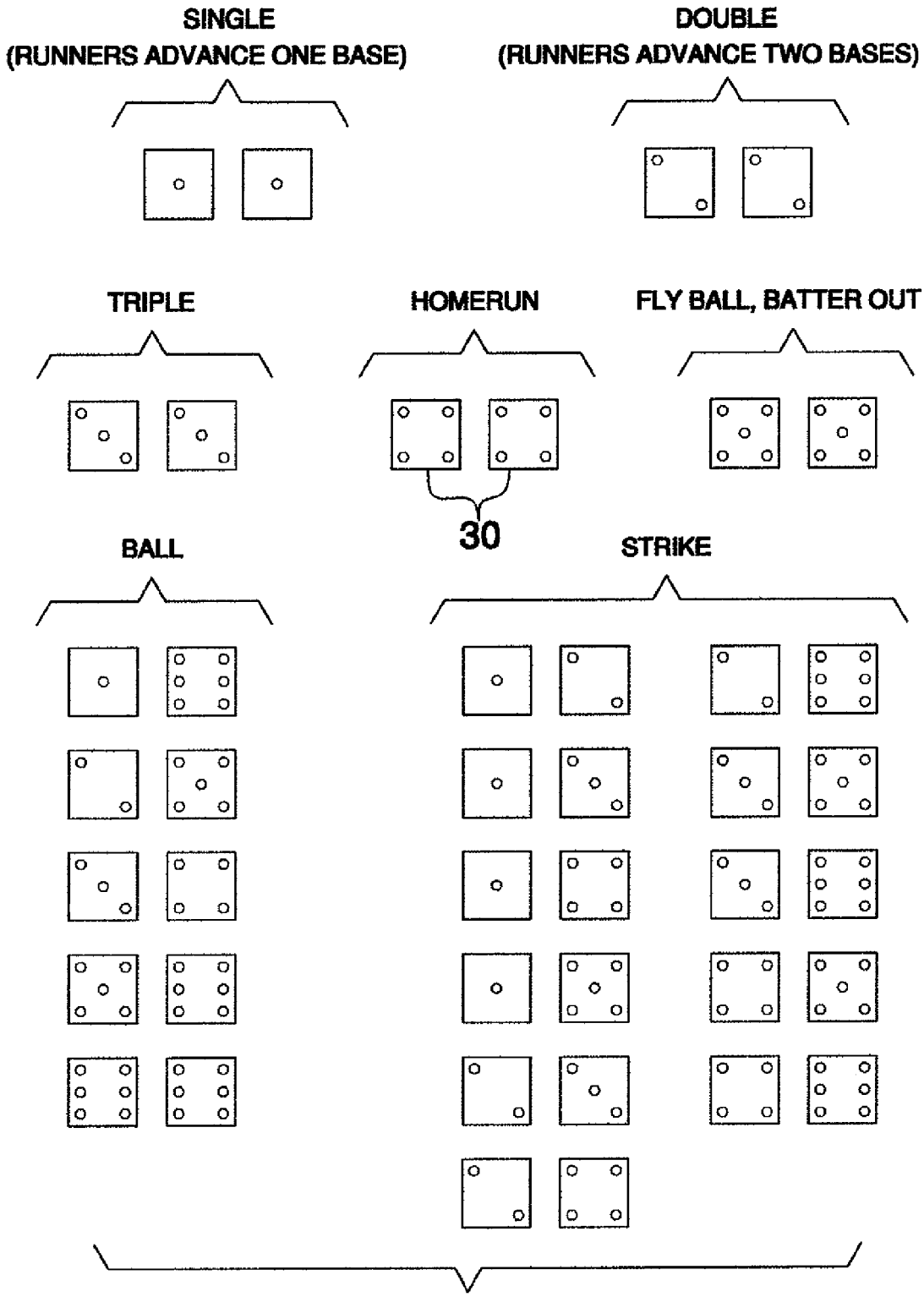
FIG. 5 is a top view of the play dice shown with different face configurations corresponding to different results of the pitch of the present invention when the game is played.

With reference now to the drawings, and in particular to FIGS. 1 through 5 thereof, a new baseball board game embodying the principles and concepts of the present invention and generally designated by the reference numeral 10 will be described.

As best illustrated in FIGS. 1 through 5, the baseball dice game system 10 generally comprises a case 12 including a bottom wall 14 and a perimeter wall 16 that extends upwardly from the bottom wall 14 to define a playing space 18 of the case 12. The case 12 has a plurality of base apertures 20 that extend into the bottom wall 14 through a playing surface 22 of the bottom wall 14. The base apertures 20 are positioned to represent bases of a baseball diamond. The case 12 includes a plurality of pitch result apertures 24. The pitch result apertures 24 are arranged in a grid comprising three strike columns 26 and four ball rows 28. The pitch result apertures 24 are positioned adjacent an area representative of home plate of a baseball diamond.

A pair of play dice 30 is rolled to determine a result of a pitch. The play dice 30 are stored in the playing space 18 when the play dice 30 are not being used. A plurality of player pegs 32 is inserted into the base apertures 20 and the pitch result apertures 24 when the play dice 30 are rolled. The player pegs 32 are positioned in the playing space 18 when the player pegs 32 are not in use. A first portion of the player pegs 32 has a first color to indicate a first team. A second portion of the player pegs 32 has a second color to indicate a second team.

Each of a pair of wing boards 34 is hingedly coupled to the perimeter wall 16 opposite the bottom wall 14. Each of the wing boards 34 is pivoted over the playing space 18 to close the playing space 18 when the case 12 is not in use. Each of the wing boards 34 has a plurality of player apertures 36 that extend through an interior face 38 of the associated one of the wing boards 34. Each of the player apertures 36 of one of the wing boards 34 receives one of the player pegs 32 of one of the teams. Each of the wing boards 34 has a channel 40 that extends into the associated one of the wing boards 34 through the interior face 38.

One of a pair of stealing dice 42 has the first color to indicate the first team and the other of the steal dice has the second color to indicate the second team. One of the stealing dice 42 is rolled with the play dice 30 to indicate the success of a stolen base. The channel 40 of each of the wing plates receives one of the stealing dice 42 when the stealing dice 42 are not being used.

A score board 44 is hingedly coupled to the perimeter wall 16 opposite the bottom wall 14 of the case 12. The score board 44 is pivoted into the playing space 18 before the wing plates are pivoted over the playing space 18 to store the score board 44 when the score board 44 is not in use. The score board 44 has a plurality of out apertures 46 that extend into the score board 44 through a score face 48 of the score board 44. The score board 44 has a plurality of score apertures 50 that extend through the score face 48. The score apertures 50 have a first section to indicate a score of the first team. The score apertures 50 have a second section to indicate the score of the second team. The score board 44 has a plurality of inning apertures 52 that extend through the score face 48 to indicate an inning of the game.

An out peg 54 is insertable into one of the out apertures 46 to indicate the number of outs for the associated inning of the game. The first section of the score apertures 50 received one of a pair of scoring pegs 56 to indicate the score of the first team. The second section of the score apertures 50 receives one of the scoring pegs 56 to indicate a score of the second team. An inning peg 58 is insertable into one of the inning apertures 52 to indicate an inning of the game. A handle 60 is coupled to and extends outwardly from the perimeter wall 16 of the case 12. The handle 60 is grasped to facilitate manipulation of the case 12 and the wing boards 34 in the closed position during storage.

In use, one of the play dice 30 is rolled by each of the players to determine which is a first player and which is a second player. An inning is started by placing of one of the player pegs 32 into a staring one 62 of the pitch result apertures 24 by the first player. The first player rolls the play dice 30. One of the player pegs 32 in the pitch result apertures 24 is moved into an adjacent one of the ball rows 28 away from the starting one 62 of the pitch result apertures 24 when a value of seven, eleven or twelve is rolled on the play dice 30. One of the player pegs 32 is moved to a first one of the base apertures 20 when the one of the player pegs 32 can no longer be moved one of the ball rows 28 away from the starting one 62 of the pitch result apertures 24. The one of the player pegs 32 is moved into an adjacent one of the strike columns 26 away from the staring one 62 of the pitch result apertures 24 when the value on the play dice 30 rolled is equal to three, four, five, six, eight, nine or ten and faces of the play dice 30 are not identical. The out peg 54 is advanced one of the out apertures 46 when the one of the player pegs 32 can no longer be moved one of the strike columns 26 away from the starting one 62 of the pitch result apertures 24.

The player pegs in the playing space 18 are advanced one of the base apertures 20 when the player rolls a pair of ones on the play dice 30. The player pegs 32 in the playing space 18 are advanced two of the base apertures 20 when the player rolls a pair of twos on the play dice 30. The player pegs 32 in the playing space 18 are advanced three of the base apertures 20 when the player rolls a pair of threes on the play dice 30. All of the player pegs 32 in the playing space 18 are advanced through the base apertures 20 and back to pitch results apertures 24 when the player rolls a pair of fours on the play dice 30. The associated one of the score pegs 56 is advanced one of the score apertures 50 for each of the player pegs 32 that is advanced through the base apertures 20 and returned to the pitch result apertures 24.

The out peg 54 is advanced one of the out apertures 46 when the player rolls a pair of fives on the play dice 30. Play by the first player is continued until the first player receives three outs. Stealing of a base by the one of players is declared with player pegs 32 in the playing space 18 and odd or even is declared. The associated one of the stealing dice 42 is rolled with the play dice 30. One of the base apertures 20 is advanced by each of the player pegs 32 in the base apertures 20 when the number shown on the stealing dice 42 matches the declaration of the player and the roll of the play dice 30 does not advance the player pegs 32 along the base apertures 20. A leading one of the player pegs 32 is removed from the base apertures 20 and advances the out peg 54 one of the out apertures 46 when the number shown on the stealing dice 42 does not equal the declaration by the player.

Play by the first player is continued until the first player receives three outs. The second player plays until the second player receives three outs and thereby ends the inning. Playing of innings is continued until the desired number of innings has been played. The game is won by the player with the most runs shown on the score board.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a baseball dice game comprising:

providing a baseball dice game system comprising a case including a bottom wall and a perimeter wall extending upwardly from said bottom wall to define a playing space of said case, said case having a plurality of base apertures extending into said bottom wall through a playing surface of said bottom wall, said base apertures being positioned to represent bases of a baseball diamond, said case including a plurality of pitch result apertures, said pitch result apertures being arranged in a grid comprising three strike columns and four ball rows, said pitch result apertures being positioned adjacent an area representative of home plate of a baseball diamond;

a pair of play dice, said play dice being rolled to determine a result of a pitch, said play dice being stored in said playing space when said play dice are not being used;

a plurality of player pegs, said player pegs being inserted into said base apertures and said pitch result apertures when said play dice are rolled, said player pegs being positioned in said playing space when said player pegs are not being used, a first portion of said player pegs having a first color to indicate a first team, a second portion of said player pegs having a second color to indicate a second team;

a pair of wing boards, each of said wing boards being hingedly coupled to said perimeter wall opposite said bottom wall, each of said wing boards being pivoted over said playing space to close said playing space when said case is not being used, each of said wing boards having a plurality of player apertures extending through an interior face of the associated one of said wing boards, each of said player apertures of one of said wing boards receiving one of said player pegs of one of the teams, each of said wing boards having a channel extending into the associated one of said wing boards through said interior face;

a pair of stealing dice, one of said stealing dice having the first color to indicate the first team and the other of said steal dice having the second color to indicate the second team, one of said stealing dice being rolled with said play dice to indicate the success of a stolen base, said channel of each of said wing plates receiving one of said stealing dice when said stealing dice are not being used;

a score board being hingedly coupled to said perimeter wall opposite said bottom wall of said case, said score board being pivoted into said playing space before said wing plates are provided over said playing space to store said score board when said score board is not being used, said score board having a plurality of out apertures extending into said score board through a score face of said score board, said score board having a plurality of score apertures extending through said score face, said score apertures having a first section to indicate a score of the first team, said score apertures having a second section indicating the score of the second team, said score board having a plurality of inning apertures extending through said score face to indicate an inning of the game;

an out peg being insertable into one of said out apertures to indicate the number of outs for the associated inning of the game;

a pair of scoring pegs, said first section of said score apertures receiving one of said scoring pegs to indicate the score of the first team, said second section of said score apertures receiving one of said scoring pegs to indicate a score of the second team;

an inning peg being insertable into one of said inning apertures to indicate an inning of the game;

rolling of one of said play dice by each of the players to determine which is a first player and a second player;

starting of an inning;

placing of one of said player pegs into a starting one of said pitch result apertures by the first player;

rolling of said play dice by the first player;

moving of the one of said player pegs in said pitch result apertures into an adjacent one of said ball rows away from the starting one of said pitch result apertures when a value of seven, eleven or twelve is rolled on said play dice;

moving of the one of said player pegs to a first one of said base apertures when the one of said player pegs can no longer be moved one of said ball rows away from the starting one of said pitch result apertures;

moving of the one of said player pegs into an adjacent one of said strike columns away from the starting one of said pitch result apertures when the value on said play dice rolled is equal to three, four, five, six, eight, nine or ten and faces of said play dice are not identical;

advancing said out peg one of said out apertures when the one of said player pegs can no longer being moved one of said strike columns away from the starting one of said pitch result apertures;

advancing said player pegs in said playing space one of said base apertures when the player rolls a pair of ones on said play dice;

advancing said player pegs in said playing space two of said base apertures when the player rolls a pair of twos on said play dice;

advancing said player pegs in said playing space three of said base apertures when the player rolls a pair of threes on said play dice;

advancing of all of said player pegs in said playing space through said base apertures and back to pitch results apertures when the player rolls a pair of fours on said play dice;

advancing of the associated one of said score pegs one of said score apertures for each of said player pegs that is advanced through said base apertures and returned to said pitch result apertures;

advancing said out peg one of said out apertures when the player rolls a pair of fives on said play dice;

continuing of play by the first player until the first player receives three outs;

declaring of stealing a base by the one of players with player pegs in said playing space and declaring odd or even;

rolling of the associated one of said stealing dice with said play dice;

advancing of one of said base apertures by each of said player pegs in said base apertures when the number shown on said stealing dice matches the declaration of the player and the roll of said play dice does not advance said player pegs along said base apertures;

removing of a leading one of said player pegs from the base apertures and advancing said out peg one of said out apertures when the number shown on said stealing dice does not equal the declaration by the player;

continuing of play by the first player until the first player receives three outs;

playing by the second player until the second player receives three outs;

ending of an inning;

continuing playing of innings until the desired number of innings have been played; and winning of the game by the player with the most runs shown on the score board.

2. A method of playing a baseball dice game comprising:

providing a baseball dice game system comprising a case including a bottom wall and a perimeter wall extending upwardly from said bottom wall to define a playing space of said case, said case having a plurality of base apertures extending into said bottom wall, said base apertures being positioned to represent bases of a baseball diamond, said case including a plurality of pitch result apertures, said pitch result apertures being arranged in a grid comprising strike columns and ball rows;

a plurality of play dice, said play dice being rolled to determine a result of a pitch;

a plurality of player pegs, said player pegs being inserted into said base apertures and said pitch result apertures when said play dice are rolled;

a score board being hingedly coupled to said perimeter wall opposite said bottom wall of said, said score board having a plurality of out apertures extending into said score board through a score face of said score board, said score board having a plurality of score apertures extending through said score face, said score apertures having a first section to indicate a score of the first team, said score apertures having a second section indicating the score of the second team, said score board having a plurality of inning apertures extending through said score face to indicate an inning of the game;

an out peg being insertable into one of said out apertures to indicate the number of outs for the associated inning of the game;

a pair of scoring pegs, said first section of said score apertures receiving one of said scoring pegs to indicate the score of the first team, said second section of said score apertures receiving one of said scoring pegs to indicate a score of the second team;

an inning peg being insertable into one of said inning apertures to indicate an inning of the game;

rolling of one of said play dice by each of the players to determine which is a first player and a second player;

starting of an inning;

placing of one of said player pegs into a starting one of said pitch result apertures by the first player;

rolling of said play dice by the first player;

moving of the one of said player pegs in said pitch result apertures into an adjacent one of said ball rows away from the starting one of said pitch result apertures when a predetermined ball value is rolled on said dice, moving of the one of said player pegs to a first one of said base apertures when the one of said player pegs can no longer be moved one of said ball rows away from the starting one of said pitch result apertures;

moving of the one of said player pegs into an adjacent one of said strike columns away from the starting one of said pitch result apertures when the value on said play dice rolled is equal to a predetermined strike value;

advancing said out peg one of said out apertures when the one of said player pegs can no longer being moved one of said strike columns away from the starting one of said pitch result apertures;

advancing said player pegs in said playing space one of said base apertures when the player rolls a predetermined single hit value;

advancing said player pegs in said playing space two of said base apertures when the player rolls a predetermined double hit value;

advancing said player pegs in said playing space three of said base apertures when the player rolls a predetermined triple hit value;

advancing of all of said player pegs in said playing space through said base apertures and back to pitch results apertures when the player rolls a predetermined home run hit value;

advancing of the associated one of said score pegs one of said score apertures for each of said player pegs that is advanced through said base apertures and returned to said pitch result apertures;

advancing said out peg one of said out apertures when the player rolls a predetermined out value;

ending of an inning occurring when continuous play by the first player results in three outs followed by three outs resulting from by the second player;

continuing playing of innings until the desired number of innings have been played; and winning of the game by the player with the most runs shown on the score board.

3. The method according to claim 2, further including the steps of:

providing a pair of stealing dice, one of said stealing dice having the first color to indicate the first team and the other of said steal dice having the second color to indicate the second team, one of said stealing dice being rolled with said play dice to indicate the success of a stolen base, said channel of each of said wing plates receiving one of said stealing dice when said stealing dice are not being used;

declaring of stealing a base by the one of players with player pegs in said playing space and declaring odd or even;

rolling of the associated one of said stealing dice with said play dice;

advancing of one of said base apertures by each of said player pegs in said base apertures when the number shown on said stealing dice matches the declaration of the player and the roll of said play dice does not advance said player pegs along said base apertures;

removing of a leading one of said player pegs from the base apertures and advancing said out peg one of said out apertures when the number shown on said stealing dice does not equal the declaration by the player.

* * * * *